US005470177A

United States Patent [19]

Hughes

[11] Patent Number: 5,470,177

[45] Date of Patent: Nov. 28, 1995

[54] HYDRO WALL

[76] Inventor: Christopher T. Hughes, Box 8036, Bennett Ave., Milford, Pa. 18337

[21] Appl. No.: 204,768

[22] Filed: Mar. 2, 1994

[51] Int. Cl.[6] ..... E02B 7/00

[52] U.S. Cl. ..... 405/115; 405/91; 405/107

[58] Field of Search ..... 405/87, 90, 91, 405/107, 115

[56] References Cited

U.S. PATENT DOCUMENTS

| | | | |
|---|---|---|---|
| 236,248 | 1/1881 | Ousterhout | 405/91 |
| 898,984 | 9/1908 | McFarlane . | |
| 2,674,855 | 4/1954 | Taylor | 405/91 |
| 3,213,628 | 10/1965 | Serota | 61/30 |
| 4,136,995 | 1/1979 | Fish | 405/115 |
| 4,511,286 | 4/1985 | Hardacre | 405/115 |
| 4,692,060 | 9/1987 | Jackson, III | 405/115 |
| 4,921,373 | 5/1990 | Coffey | 405/115 |
| 4,981,392 | 1/1991 | Taylor | 405/115 |
| 5,040,919 | 8/1991 | Hendrix | 405/115 |

*Primary Examiner*—David H. Corbin
*Attorney, Agent, or Firm*—Sandra M. Kotin

[57] ABSTRACT

A barrier wall for containment of flood waters composed of multiples of modules which are easily transported to the site and erected without tools, by only a few persons with no special skills or training. Flexible coversheets, having foam seals which conform the modules to the ground and prevent flood waters from undercutting the ground and rendering the wall unstable are placed on the ground. Compartmented flexible ballast cell units are placed on the cover sheets just over the seals. The edges of the coversheets are coupled together as are the ends of the ballast cell units for continuity of the wall. The ballast cells can then be filled with water, sand, earth, gravel or other available material and the front portions of the cover sheets brought up and over the ballast cells to form a wall. An additional tier can be added to double the height of the wall. When waters are expected to rise higher than twice the height of the cells, one tier of ballast cell units is used and lightweight support trusses are positioned in the ballast cells before they are filled. Connectors and guy wires add stability to the trusses. The front portions of the cover sheets are then brought up and fastened to the tops of the trusses on the side facing the flood waters. Rigid armor plate sections can be placed over the cover sheets to protect them from being damaged by floating debris. The front edges of the trusses form a catenary curve which defines the face of the wall and serves to transmit the force of the water downward reinforcing the seal to the ground. Any number of modules can be used and will conform to the terrain.

16 Claims, 7 Drawing Sheets

HYDRO WALL

FIELD OF THE INVENTION

The instant invention relates to a lightweight portable unit, to be used singly or in groups, to be further supported and heightened by the addition of covered struts, to be erected quickly by unskilled persons, and to be filled with ballast at the site, so as to function as a levee or retaining wall to protect against rising waters during flood conditions.

BACKGROUND OF THE INVENTION

Periodic flooding of bodies of water has caused serious destruction and loss of life and property. In areas where flooding recurs, dams and levees have been built to contain rising waters. Sometimes these are sufficient, but more often s they are not and the water rises above the levees or is too powerful to be contained and breaks through them.

There have been many patents for portable dams developed for use in and alongside river beds and other waterways, but little has been done to devise portable means to stem the rise of flood waters other than the use of sandbags. Some inventors have utilized water as the ballast instead of sand.

Serota, in U.S. Pat. No. 3,213,628 teaches the use of plastic containers in the shape of a rectangular solid which can be filled with water and lashed together to form a wall or barrier. The containers can be stacked to form barriers of different heights, and additional units can be placed along the back side for added strength. The containers can be anchored to the ground to prevent movement. They are filled with water using a pump and are easily emptied when no longer needed. When empty, the containers are stored flat. The device of Serota is best used in a gorge or similar passageway.

Jackson, III, (U.S. Pat. No. 4,692,060) teaches an elongated water filled tube with side panels in the shape of an equilateral triangle. The tubes are surrounded by wooden frames fastened through loops in the sides of the tubes. The flames are used for support and to help in maintaining the triangular shape of the tubes when filled. The supported units can be placed end to end to form a wall of any desired length. The units can be stacked to double the height of the wall. The tubes and frames can easily be transported to a flood site and assembled. The tubes are filled by the use of a water pump. A similar device was developed by Coffey (U.S. Pat. No. 4,921,373), but he emphasizes an A-frame structure which can be made from highway or construction barriers. A flexible tube with triangular cross-section is supported by the frame and filled with water. The units can be placed end to end to extend the wall as needed. Velcro strips on the ends of the tubes facilitate fastening the units together. No stacking or backup row is noted.

Another long tubular container (can be 100 feet long) with triangular cross-section was developed by Hendrix (U.S. Pat. No. 5,040,919). The device of Hendrix is not in the form of an equilateral triangle, but one having sides of three different lengths. The longest side of the triangle faces the oncoming water, the side of median length forms the base and the shortest side is the back support. A skirt is attached to the container along the lower front edge to form a seal with the ground to prevent the rising waters from flowing under the unit. This device uses no outside support, but is very heavy when filled with water. Additional units can be placed end to end to provide a long wall. These units can not be stacked.

Another approach to the portable module as a flood barrier was taken by Taylor in U.S. Pat. No. 4,981,392. Taylor's module consists of two cylindrical chambers to be filled with water. The two cylinders are connected by a rectangular webbing proportioned to facilitate stacking the modules to form a barrier wall. The modules can be made in varying lengths. They can be placed side by side and/or stacked. A staggered stacking pattern can produce a barrier of considerable height and thickness. End to end placement results in a wall of any desired length. There is no mention of a ground seal or any means to prevent the flood water from passing beneath the modules.

All of the aforementioned devices may be effective in varying degrees in the path of rising water if the water is not too high, is not coming in rapidly and is not moving with great force. There is still a need for a strong, portable and easily constructed barrier for use against flood waters carrying considerable force so there is resistance to lateral movement as the waters rise and forces increase. There is also a need for such a unit to be sealed to the uneven ground so that swirling waters cannot undercut the ground support and cause the barrier to slide or shift position. A need exists for a continuous barrier of considerable weight and stability which can be further heightened quickly and easily without requiring additional weight or ballast. Such a barrier should be usable with a variety of ballast materials to accommodate materials available at the site or those most easily brought there.

BRIEF SUMMARY OF THE INVENTION

Quickly rising flood waters are a threat to life and property. There are times when there is no warning of such a condition, and therefore no immediate actions can be taken for protection. Often, there is advance notice, and usually sandbags are filled and stacked and/or dirt walls are constructed. Both of these methods require time and supplies of sand. Formation of dirt walls requires the availability of heavy earth-moving equipment.

The instant invention relates to lightweight portable units or modules which can be quickly set up by anyone, without special skills. Ballast cells can be filled with water and will provide a strong wall able to resist considerable forces. The cells may also be filled with sand, gravel, earth or other such material, if available, and the resulting barrier will thereafter provide even stronger protection. The modules can be placed and attached end to end to form an unbroken barrier of any desired length. Lightweight support struts and a waterproof cover increase the height of the barrier without having to lift additional ballast materials to provide the added height. The design of the structure with the struts and cover in place is such that the weight of the oncoming waters is translated into a downward force which dramatically adds stability to the barrier.

An object of the present invention is to provide a lightweight, transportable, continuous, modular barrier wall or emergency levee which can be erected quickly, of any desired length, using unskilled labor, and does not require the use of special tools.

It is another object of the present invention to be able to provide a barrier that can completely surround an individual structure or area to protect same from rising flood waters.

It is a further object of the present invention that the modules can be used to add height to an existing levee or fill in areas of a damaged barrier wall.

It is a still further object of the present invention that modules can be assembled quickly and used to buy time while a larger, earthen wall is constructed, if that should become necessary.

Another object of the present invention is to equip the modules with seals capable of conforming with the ground beneath them, especially in uneven terrain, to prevent the rising water from passing underneath the barrier or undercutting the ground support.

It is another object of the present invention that the structure's resistance to lateral movement and the effectiveness of the ground seals increase with the increasing height of the flood water it is holding back.

A still further object of this invention is to have the modules collapsible when not in use so they can be stored flat and easily transported.

The modules of the instant invention are a combination of essentially two portions, the ballast unit and the covered frame. The base or ballast unit consists of a generally rectangular chamber divided into a series of cells. The ballast unit is made of a flexible material which is easily unrolled on the ground and the cells filled with ballast. The ballast units can be used alone if the waters are not expected to rise more than about forty-eight inches. A waterproof fabric cover sheet can be used with the ballast cell units. If a greater threat is anticipated, "triangular" frames with forward and rear support or strut sections are added before the cells are filled with ballast. The forward strut sections are placed into each cell, and when all are in place and the cells are filled, they are covered by a waterproof fabric cover sheet. The back sections rest on the ground behind the ballast cells and serve to stabilize the frame. The frame is proportioned to direct the lateral force of the rising water downward toward the ground. The ballast cells can be filled with water, sand, stone, clean fill or the like. Beneath the ballast cells and the base of the back frame sections is a compressible seal which can conform to the terrain and prevent seepage of water under the barrier and undercutting of the ground on which the barrier rests. This seal minimizes any sliding or shifting of the unit.

Further objects and advantages of the present invention will become apparent from the accompanying description and drawings.

11A is a perspective view of a truss unit opened and ready to be positioned.

Figure 11C:
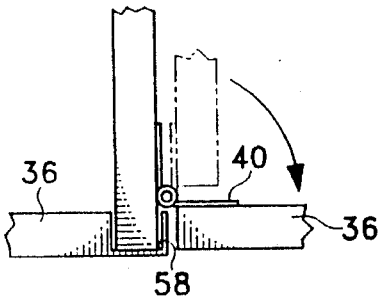
Figure 11B:
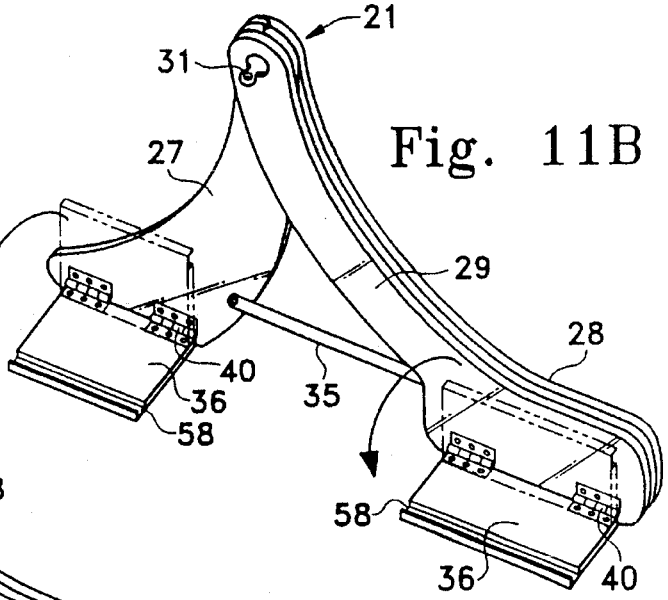

FIG. 11B is a perspective view of a truss unit opened and with the foldable support pads turned down.

FIG. 11C is close-up side view of the bottom of a strut resting in the channel of the support pad of the adjacent strut and showing the placement of the hinge.

Figure 12:
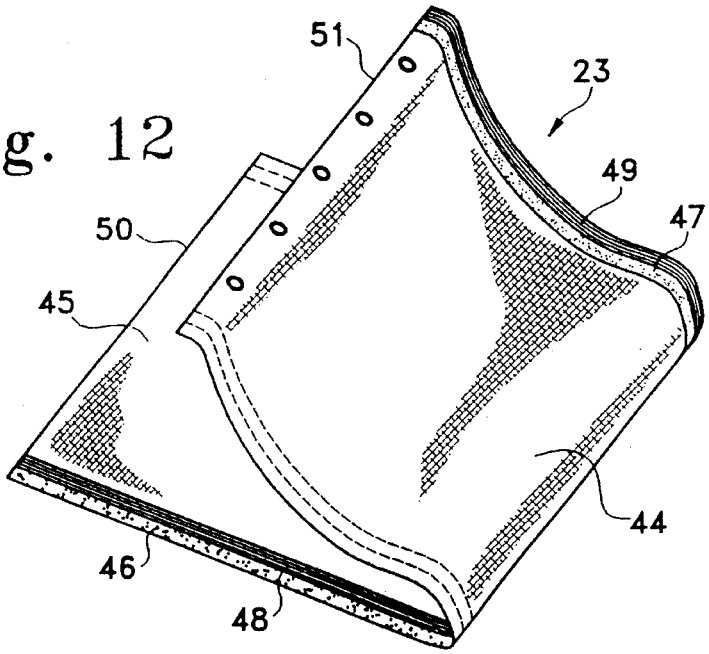

FIG. 12 is a perspective view of the cover sheet as it would be positioned on the hydro wall unit and having edges fitted for joinder with another unit.

Figure 13A:
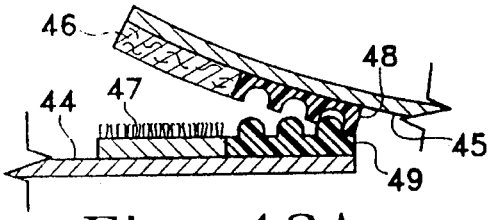

FIG. 13A is a close-up cross-section view of the edge detail of the cover sheets of two Hydro Wall units being joined together.

Figure 13B:
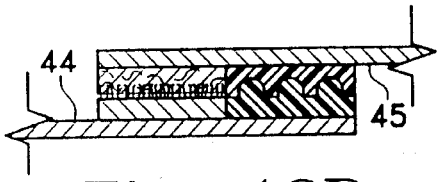

FIG. 13B is a close-up cross section view of the edge detail of the cover sheets of two Hydro Wall units joined together.

Figure 14:
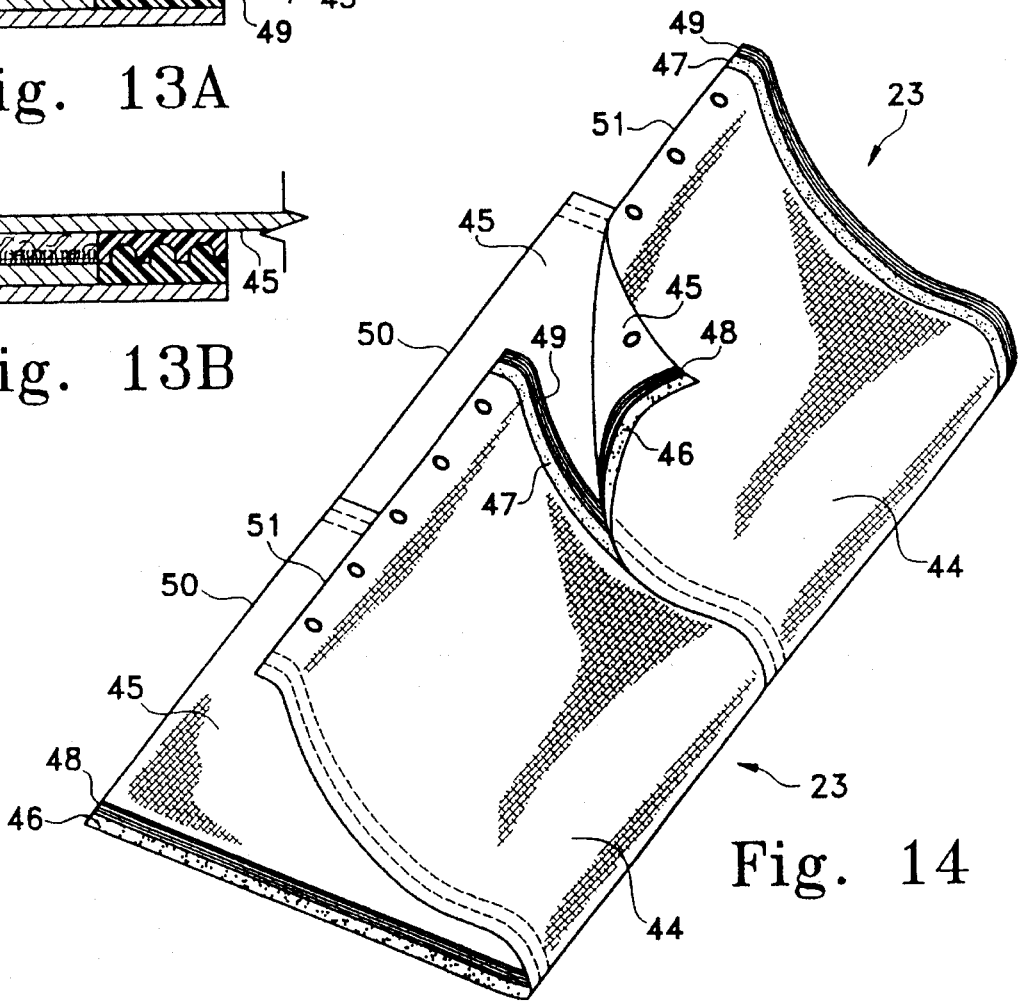

FIG. 14 is a perspective view of the cover sheets of two Hydro Wall units being joined together.

Figure 15:
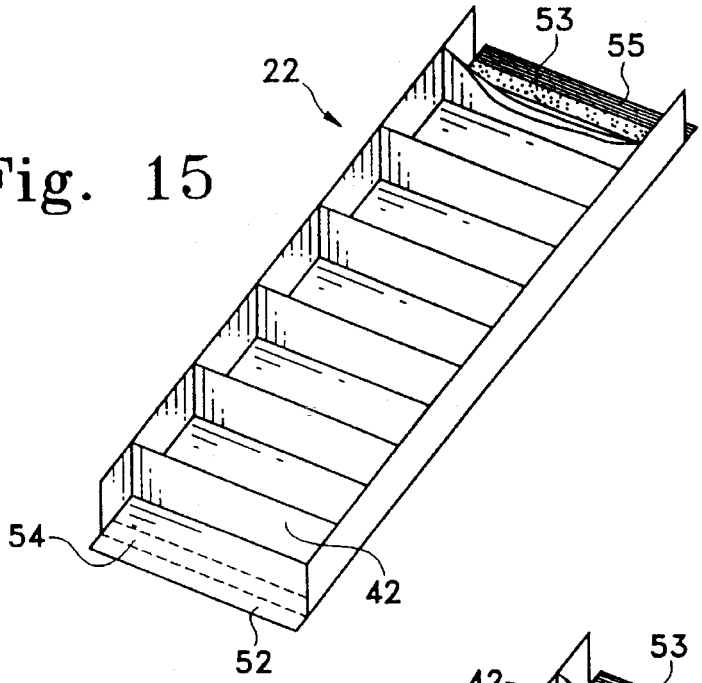

FIG. 15 is a perspective view of a ballast cell unit spread out and showing the means of joining the units at both ends.

Figure 16A:
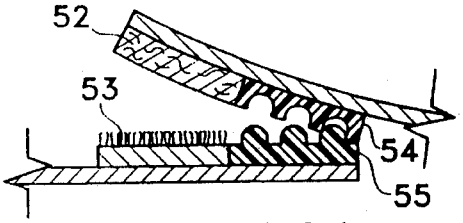

FIG. 16A is a close-up cross-section view of the edge detail of two ballast cell units being joined together.

Figure 16B:
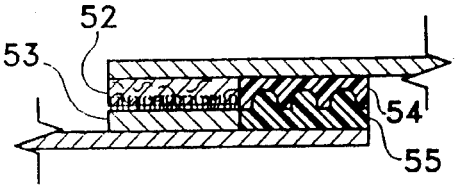

FIG. 16B is a close-up cross-section view of the edge detail of two ballast cell units joined together.

Figure 17:
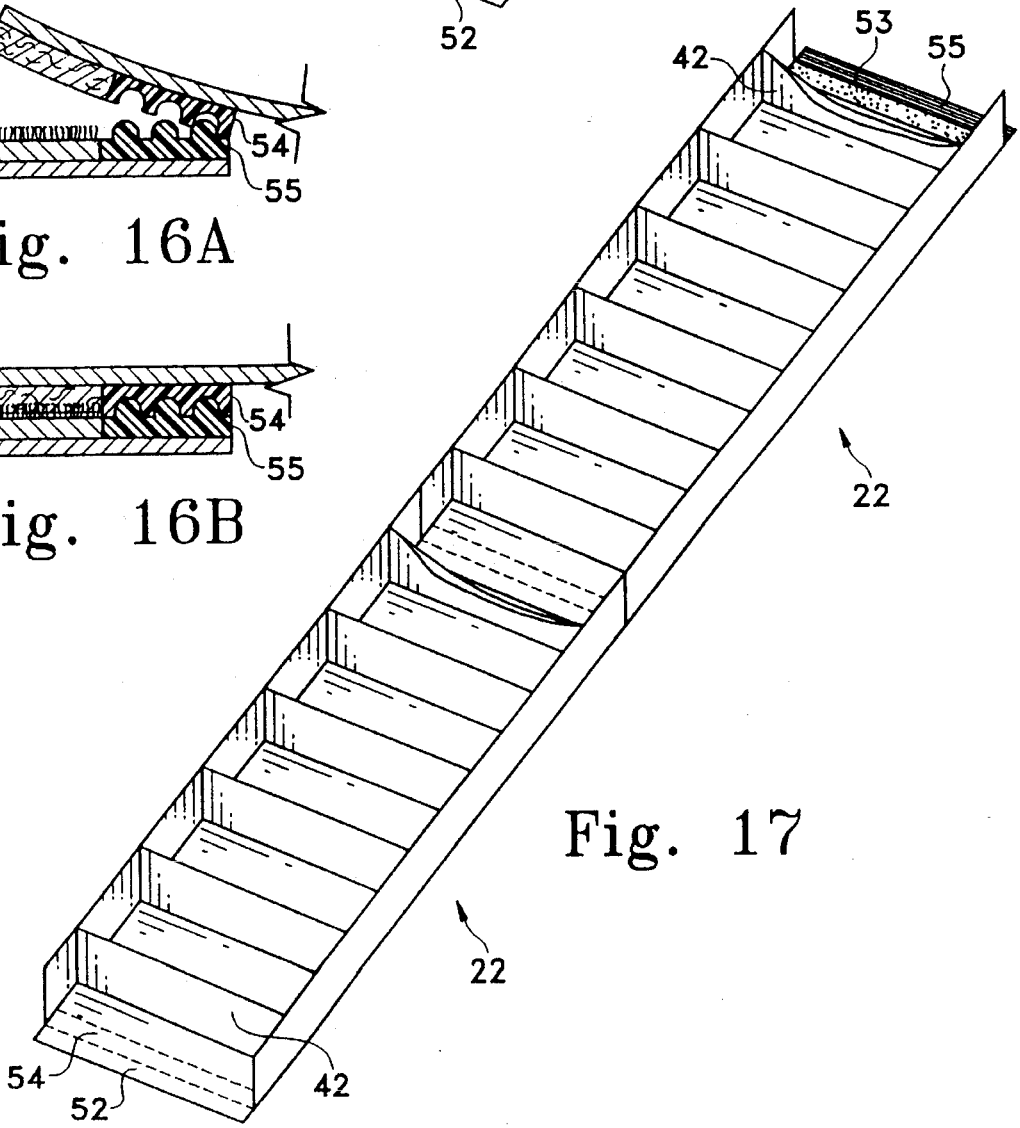

FIG. 17 is a perspective view of two ballast cell units joined together.

DETAILED DESCRIPTION OF THE INVENTION

Figure 1:
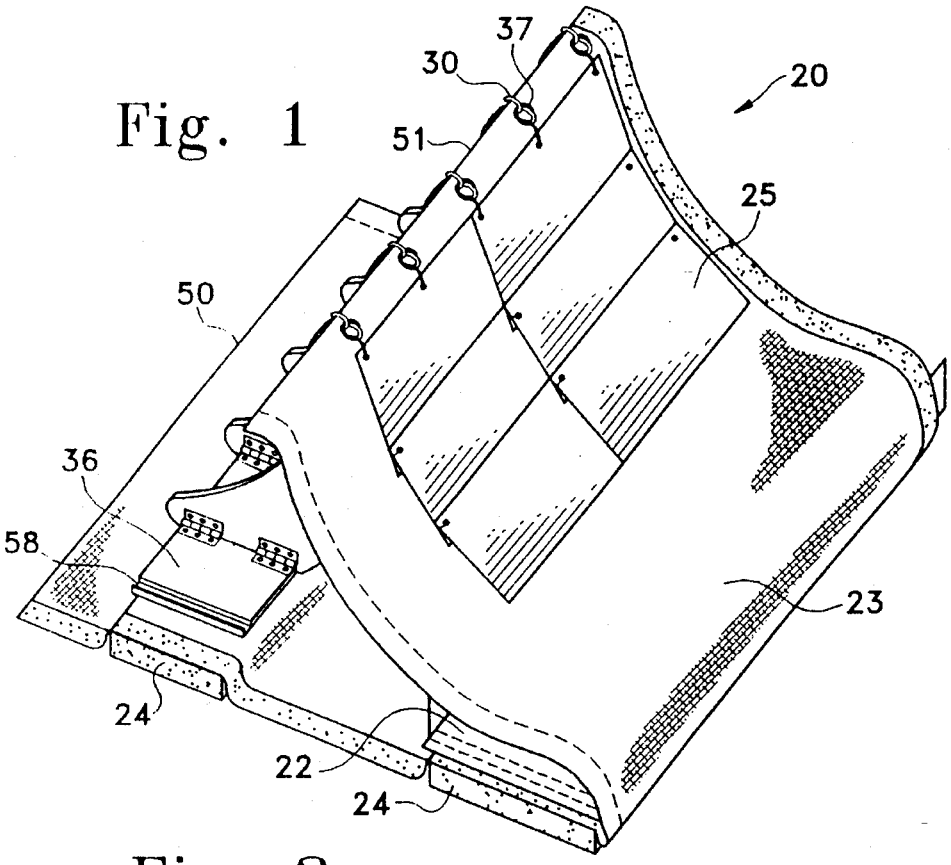
FIG. 1 is a perspective view of one unit of the Hydro Wall with all components implace.
Figure 2:
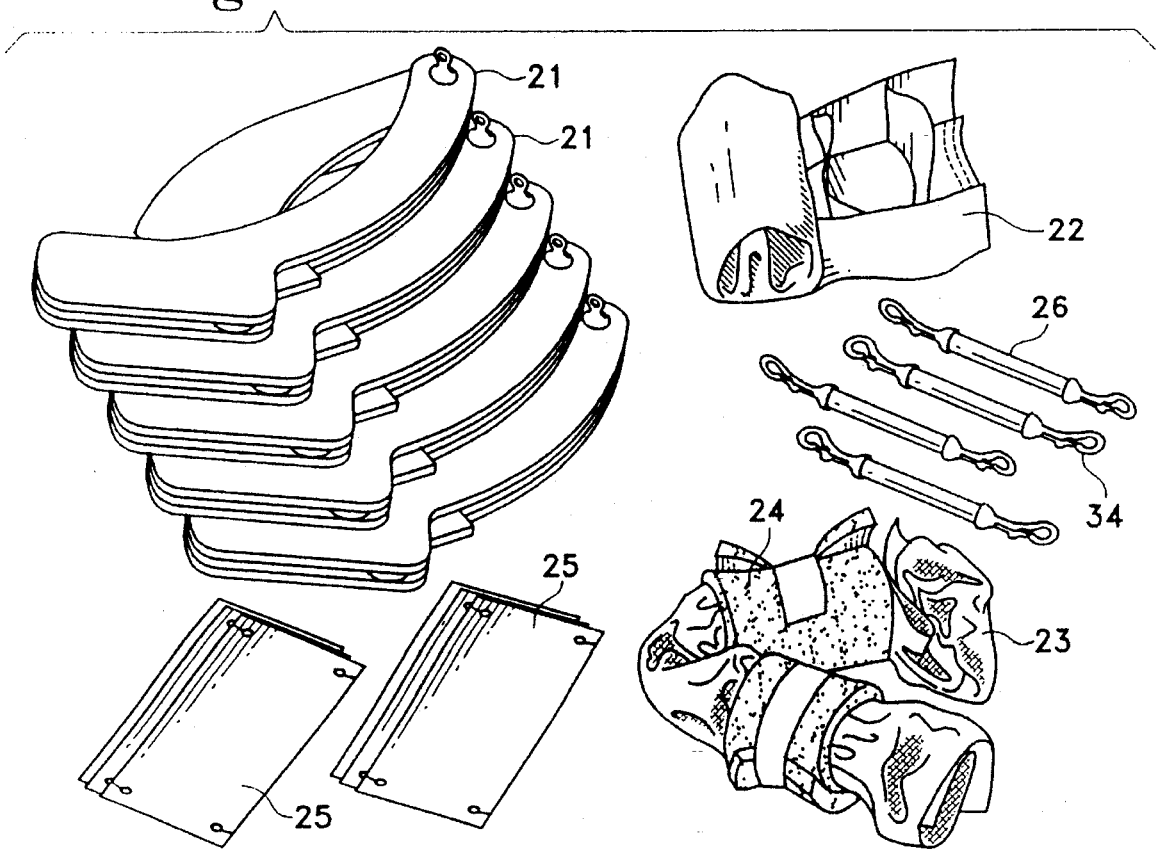
FIG. 2 is a perspective view of all of the components folded and ready for storage or transport.

The Hydro Wall module 20 (FIG. 1) consists of four main components as seen folded in FIG. 2: a cover sheet 23 with foam ground seals 24 attached, compartmented ballast cell unit 22, foldable truss units 21, and foldable armor plate sections 25. Rigid connector rods 26 with snap connectors 34 at each end are used to connect the trusses together. The basic components can be assembled quickly and easily. The ballast 39 is added at the site (FIG. 8) and can be removed after use so the components can be disassembled for transport and storage.

The cover sheet 23 is a long rectangular sheet made of a strong, flexible, waterproof fabric. It is of sufficient length such that the back portion 50 lies under ballast cell unit 22 and the opened truss units 21 and the remainder can be extended up to the top of the front of the truss units 21 and secured there to form the face of the Hydro Wall module 20. (See FIG. 9) Affixed at two intervals near the back portion 50 of the cover sheet 23 and on the obverse surface 44 are two wide bands of compressible polymeric foam material which extend across the width of the cover sheet 23. (FIGS. 3 and 4) These two foam seals 24 conform the Hydro Wall module 20 to the shape of the terrain and seal the module to the ground so as to prevent seepage of water under the barrier and to prevent undercutting of the ground on which the barrier rests. Two bands of foam with space between them provide better protection then if one continuous piece of foam was used. The two foam seals 24 are strategically spaced apart so as to lie beneath the extended struts of each truss unit 21. (See FIG. 6)

The edge of the front or forward end 51 of the cover sheet 23 is turned under forming a double band 43 of fabric. Equidistantly spaced along the double band 43 are a series of reinforced openings 38 to facilitate attachment of the front end 51 of the cover sheet 23 to the tops of the truss units 21. The cover sheet 23 partially unfolded with foam seals 24 in place can be seen in FIG. 4.

Figure 3:
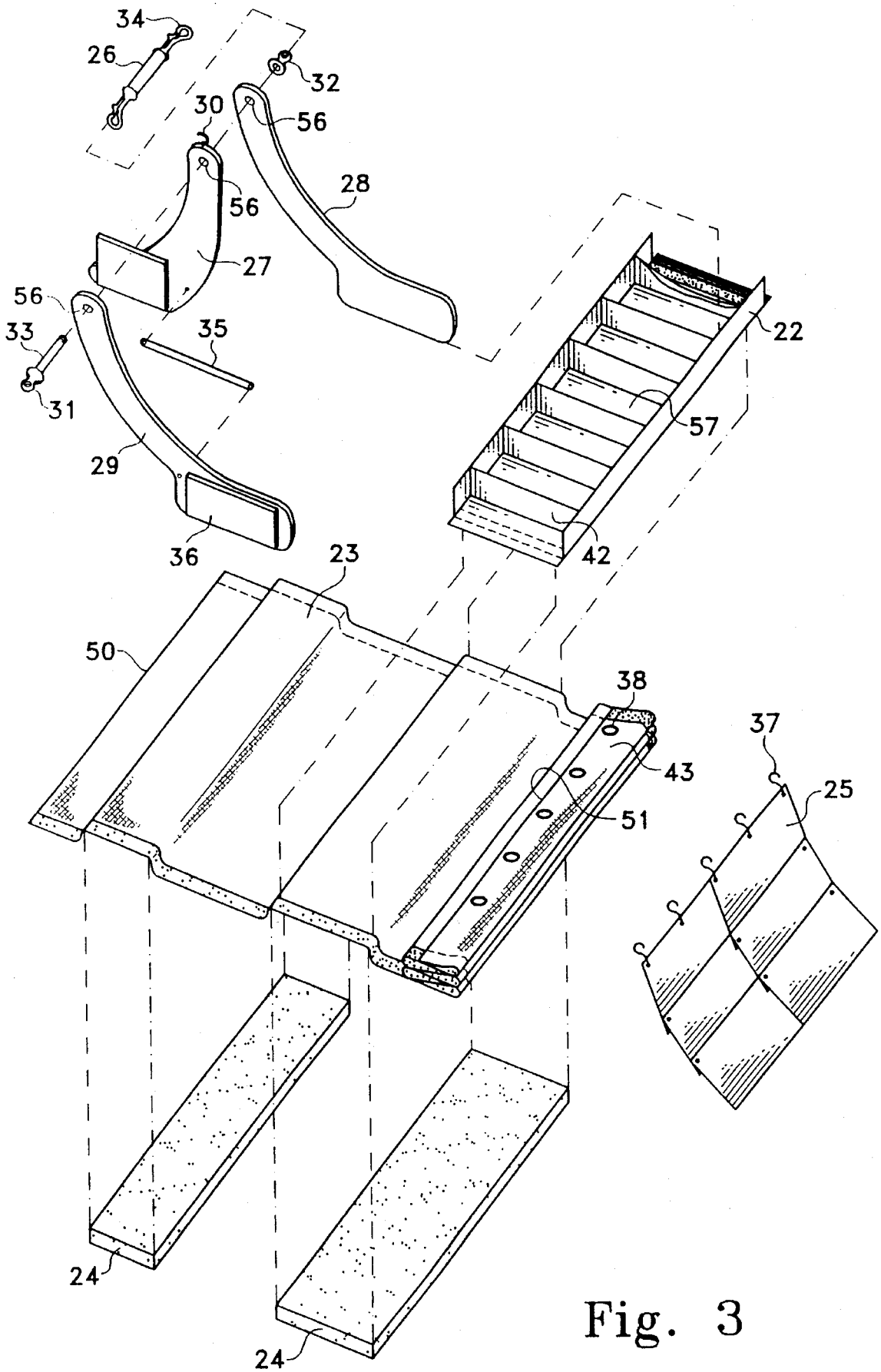
FIG. 3 is an exploded view of one unit of the Hydro Wall showing all components and their relationship to each other.
Figure 5:
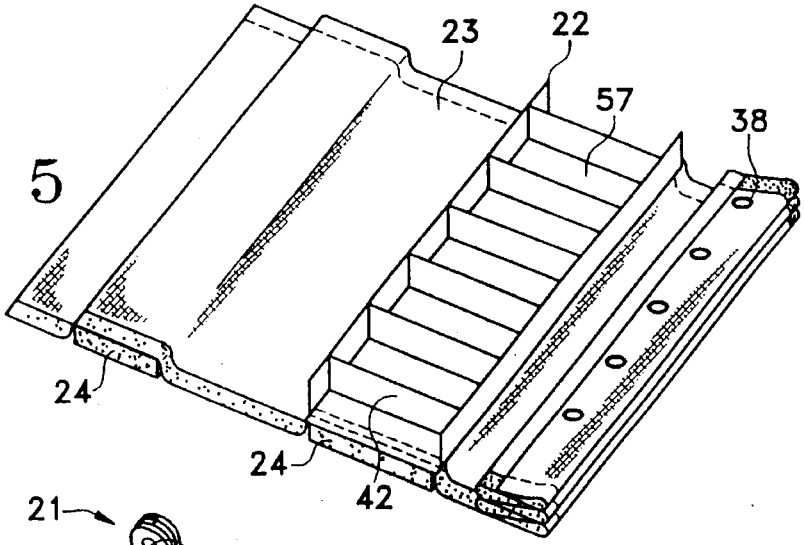
FIG. 5 is a perspective view of the cover sheet, foam seals and with the ballast cell unit properly positioned above the forward foam seal.
Figure 7:
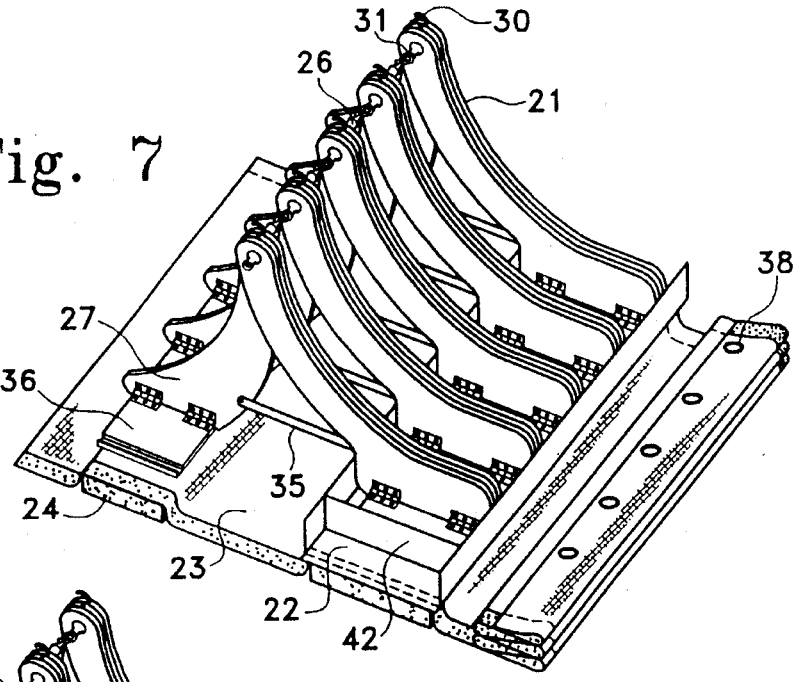
FIG. 7 is a perspective view of the cover sheet, foam seals, ballast cell unit and several truss units in place.
Figure 8:
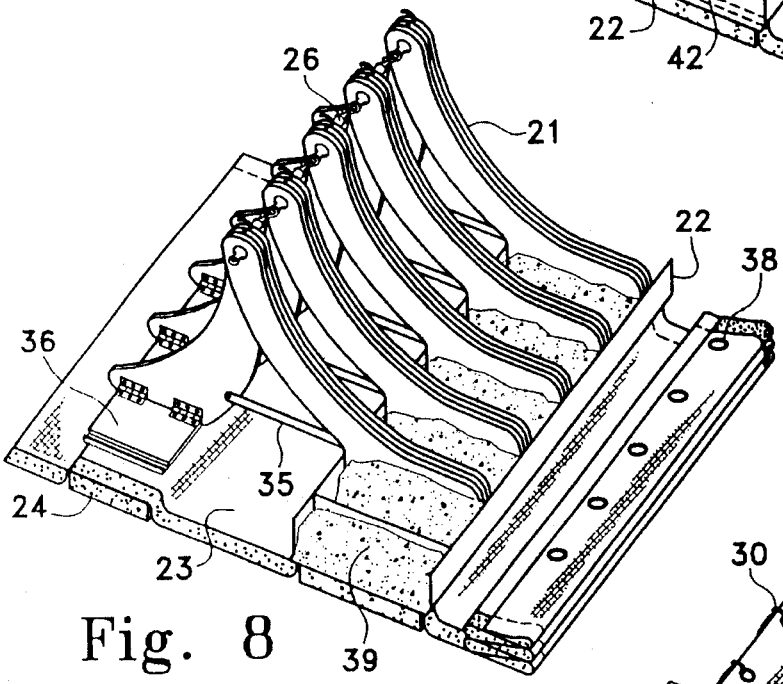
FIG. 8 is a perspective view showing everything as in FIG. 7 with the addition of ballast material filling the ballast cells.
Figure 9:
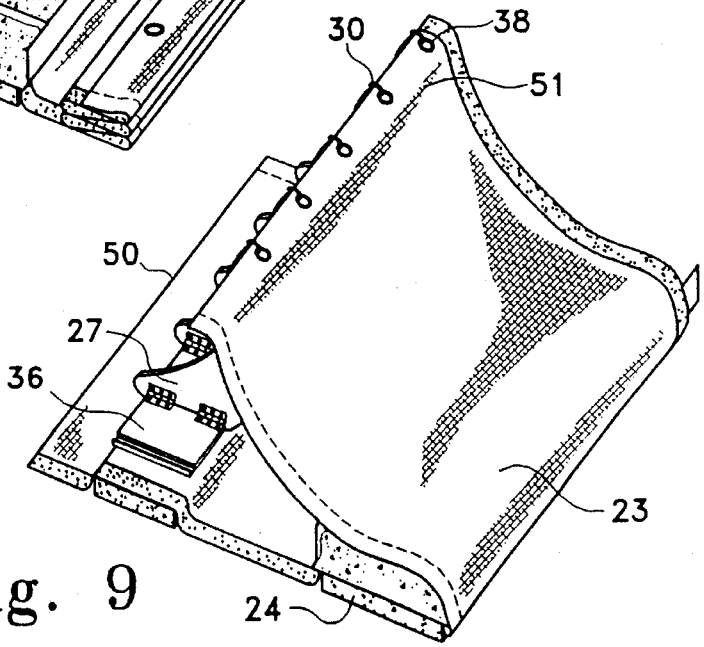
FIG. 9 is a perspective view of the unit of FIG. 8 with the cover sheet pulled up and fastened on to the top of the truss units.

A ballast cell unit 22 made of a strong, flexible, waterproof material is placed atop the coversheet 23 above the forward foam seal 24. The ballast cell unit is rolled or folded for storage and transport (FIG. 2) and is simply unrolled right atop the properly positioned cover sheet 23 as in FIG. 5. The ballast cell unit 22 is a long trough with a series of evenly spaced partitions 42 dividing the unit into individual ballast cells 57. The entire unit and partitions are made of the same material. The partitions 42 are sealed to the outer fabric such that each cell 57 can function even if the adjoining ones become damaged. Once the ballast cell unit 22 is in place, the truss units 21 can be positioned. Each truss unit 21 is made up of three "legs" or struts, the outside forward strut 28 and the inside forward strut 29, and a rearward strut 27 (FIG. 3). The overall configuration of the opened truss unit 23 is triangular whereby the front facing the oncoming waters is the longest side of the triangle, the base is the median side and the back is the shortest side. Each strut is upwardly curved with a flat bottom portion at its base for stability. The two forward struts 28 and 29 are formed with a catenary curve along their front edges. The catenary curve dictates the shape of the front face of each module 20 and of the resulting Hydro Wall. The Hydro Wall module 20 is designed to direct more force downward than laterally. The catenary curved wall face translates the lateral forces of the water downward toward the ground. The rear strut 27 is also curved, but the curve is steep and the rear strut 27 functions as a brace or support. (FIGS. 7 through 9).

Figure 6:
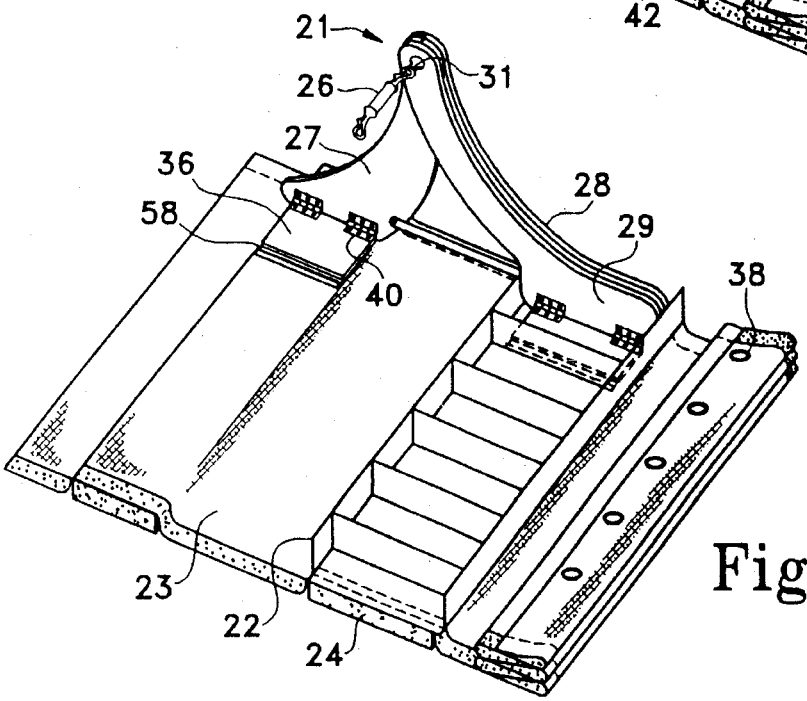
FIG. 6 is a perspective view of the cover sheet, foam seals, ballast cell unit and with one truss unit in place.

The three struts 27,28 and 29 each have an opening 56 centered in the top portion through which a bushing 33 is positioned. The bushing 33 is fitted with a loop 31 at one end and is threaded at the other end. The threaded end screws into a nut 32 which is also fitted with a loop. The truss units 21 are connected to each other with rigid connecting rods 26 supplied with spring connectors 34 at each end.(FIG. 3) The spring connectors 34 coact with the loops to connect the adjoining trusses (FIGS. 6, 7 and 8). Other types of connecting means known in the art may be used. The bushing 33 does not fit openings 56 tightly so the struts can be moved in reference to each other and the truss unit 21 can be opened and closed as needed.

Each truss unit 21 has a hook 30 or other fastening means fixedly attached at the top to receive the openings 38 in the cover sheet 23. A flexible and adjustable strap 35 is attached to the rearward strut 27 and the inside forward strut 29. This strap 35 serves two purposes. First, it prevents the struts from opening too far, which will upset the stability of the unit, and second, by being adjustable, it permits each truss to be set separately. This is necessary if the terrain is uneven and/or exhibits a variation of elevations. When the adjoining truss units 21 are connected by attaching the spring connectors 34 of the connecting rods 26 to the loops of the bushings 33 and nuts 32, they become as one continuous unit. This type of connection provides stability but also maintains a degree of flexibility necessary on uneven terrain. See FIGS. 7, 8 and 10. To insure stability, guy wires 41 can be added to rearward struts 27 at the back of the module 20. (FIG. 10) The guy wires 41 prevent side-wise collapse and will be particularly important if the terrain is very uneven.

Figure 11A:
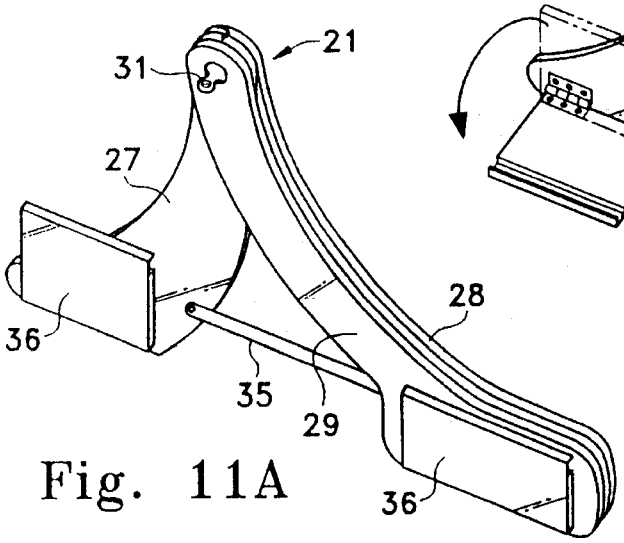

Affixed by hinges 40 to the base of the rearward strut 27 and the inside forward strut 29 are foldable support pads 36. See FIGS. 11A, 11B and 11C. The support pads 36 are made of the same rigid material as the struts. These pads 36 are unfolded when the struts are positioned for use. In addition to adding support to each truss unit 21, the pads 36 act as spacers to maintain optimum distance apart of the truss units 21. The pads 36 on the inside forward struts 29 also function as bottom supports and to maintain the shapes of the individual ballast cells 57. See FIGS. 6 and 7.

To add stability to the Hydro Wall unit 20, each support pad 36 has a channel 58 near its outer edge. The base of the strut from the next adjoining truss unit fits into this channel 58. See FIG. 11C. This is easily done with the rearward struts 27. To properly utilize this structure, placement of the forward struts 28 and 29 into the ballast cell unit 22 must be done carefully. The outside forward strut 28 must be placed on one side of the ballast cell partition 42 and the inside forward strut 29 must be positioned on the other side. When placed this way, the base of the forward strut from the adjoining truss fits into the groove 58 of the support pad 36 in the same manner as that of the rearward one.

The hinges 40 on the support pads 36 are attached slightly above the bottom edge of the strut and are constructed to bring the pads forward so as not to interfere with the base of that strut fitting into the channel 58 of the support pad 36 of the adjacent strut, as can be seen in FIG. 11C.

By interlocking the bases of the truss units 21, not only is proper spacing achieved, but the downward forces are evenly distributed along the front and rear bases formed therefrom. The forward struts resting in the ballast cells will lie directly atop one foam seal and the rearward struts when properly positioned will lie directly atop the other foam seal ensuring that the downward forces rest on the seals. This results in one continuous Hydro Wall and enhances the continuity of the conforming seal with ground beneath it.

When setting up the Hydro Wall one truss unit 21 is used for each individual ballast cell 57. The forward struts 26 and 29 are placed in adjacent ballast cells 57 with the partition 42 between them and the support pad 36 on the inside forward strut 29 is unfolded to fit firmly in the bottom of the cell 57. The rearward strut 27 is moved backward until it rests squarely atop the rear foam seal 24 and the adjustable strap 35 is set to maintain the necessary spacing of the forward and rearward struts. The support pad 36 on the rearward strut 27 is then unfolded before the next truss unit 21 is positioned. See FIGS. 6, 7 and 11B.

When all of the trusses 21 have been placed in the cells 57, the cells can be filled with ballast 39. (FIG. 8) The ballast 39 can be water, sand, gravel, earth or any other similar material available at the site. If sand or gravel is used, a truck can be driven along the ttydro Wall and the ballast can be delivered by means of a chute directly into the cells. If water is to be used as ballast, a portable pump can be used to pump water from a nearby source, or from the rising flood waters.

Figure 10:
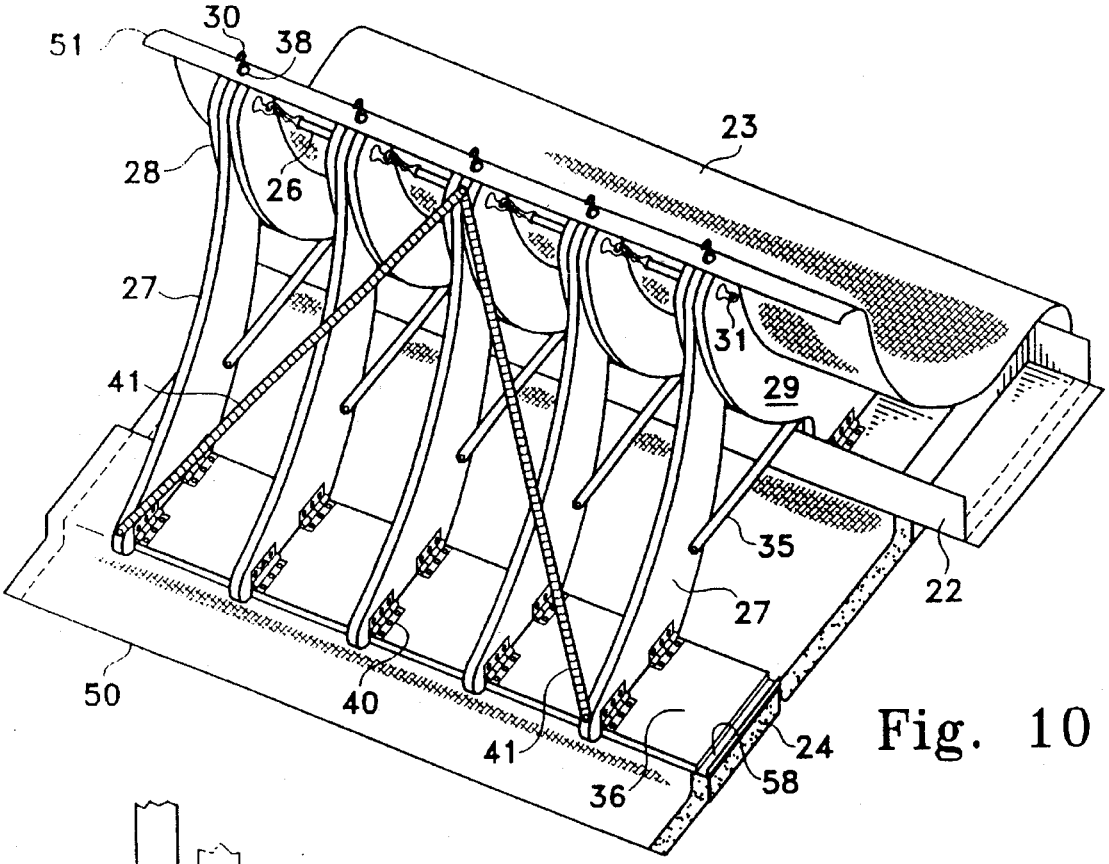
FIG. 10 is a perspective view of the back of one Hydro Wall unit.

When the cells have been filled with ballast, the front end 51 of the cover sheet 23 is pulled up to the top of the trusses 21 and fastened thereto by fitting the openings 38 over the hooks 30 as in FIGS. 9 and 10. The Hydro Wall module 20 is now ready for use, but the fabric face of the wall is vulnerable to damage from floating debris and sharp objects that can be forced against it by the flood waters. To protect the fabric, armor plate sections 25 can be connected to the front of the wall. The armor plate sections 25 are composed of three or more plates of lightweight but strong and rigid polymeric material hingedly connected together and having a loop 37 affixed to the upper edge of the top plate. The sections are folded for storage and transport as seen in FIG. 2. To utilize the armor plate sections 25, they are unfolded and connected to the wall by passing the loops 37 over the hooks 30 on the top of the trusses 21 and over the cover sheet 23. The armor plate sections 25 can be spaced along the Hydro Wall, but for the best protection they should be placed so they overlap as seen in FIG. 1.

FIG. 1 is a perspective view of the front of one complete Hydro Wall module 20, and FIG. 10 is a perspective view of the back of such a module. Any number of modules can be placed side by side to form a continuous wall of any desired length. The wall can be straight, curved or can completely surround a structure or area. To prevent flood waters from breaking through the wall, the modules are sealed together. The cover sheets 23 have sealing means along each longitudinal side which run the full length of the sheets. Along the outer edge of one side of the obverse surface 44 of each cover sheet 23 is a strip of zip-lock fastener (male portion) 49 and a strip of loop-type fastener (Velcro ®) 47 just inside the zip-lock strip. On the reverse surface 45 of each cover sheet 23 and along the outer edge of the opposite side there is a strip of loop-type fastener (Velcro®) 46 and a strip of zip-lock fastener (female portion) 48 just inside, as illustrated in FIGS. 12, and 13A and 13B.

To seal two modules together, the adjacent edges are overlapped and the Velcro® strips and zip-lock strips are brought together and made to coact as seen in FIGS. 13A, 13B and 14. The double closure provides a good seal and the resulting wall can withstand a great deal of forward thrust. The orientation of the sealing strips is specific with the Velcro® closure lying outside the zip-lock seal when seen from the front or flood-side. This orientation keeps the seal fiat and the Velcro® serves to protect and reinforce the zip-lock seal. The armor plate units 25 will also protect from force against the seal itself and help to maintain the integrity of the Hydro Wall.

The ballast cell units 22 also have sealing means along each end. At one end the sealing means is located on the top surface and is a zip-lock strip (male portion) 55 with a strip of loop-type fastener (Velcro®) 53 just inside. At the other end the sealing means is on the under surface and is a strip of hook-type fastener (Velcro®) 52 with a zip-lock strip (female portion) 54 just inside. (See FIGS. 15, 16A and 16B)

Figure 4:
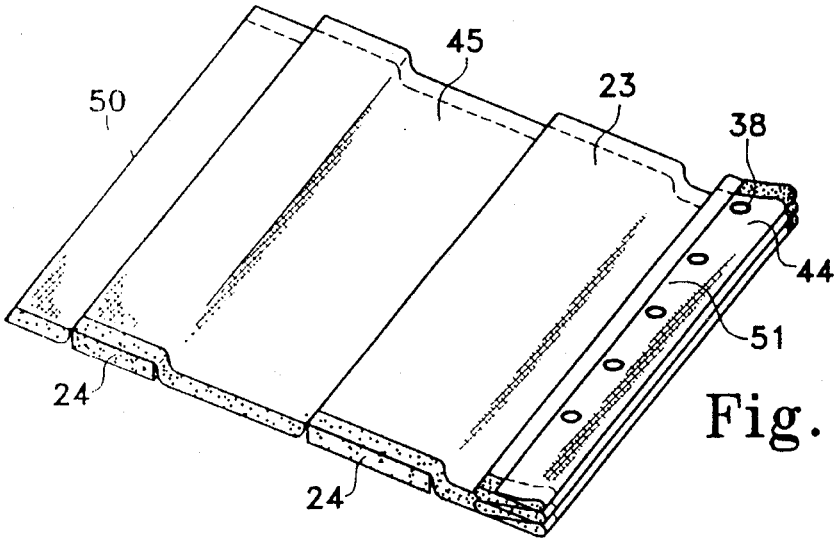
FIG. 4 is a perspective view of the cover sheet partially unfolded with the foam seals in place.

When assembling the Hydro Wall, the cover sheets 23 are placed on the ground and partially unfolded as in FIG. 4. The unfolded portions are joined together as in FIGS. 13A and 13B. The ballast cell units 22 are placed end to end on the cover sheets 23 over the forward foam seals and joined together (FIGS. 16A, 16B and 17). The trusses can then be set up and the cells filled with ballast as previously described.

In one embodiment of the instant invention the ballast cell unit 22 is ten feet long (the width of the Hydro Wall module), twenty-four inches high, and thirty-six inches deep (front to back). The partitions are placed every twenty-four inches along the length to afford five ballast cells 57 to each unit.

If the flood waters are not expected to rise more than about forty-eight inches the truss units are not necessary. The cover sheet 23 with the foam seals 24 is put in place on the cleared ground, one ballast cell unit 22 placed on top (see FIGS. 4 and 5) and the cells filled with ballast material. A second tier can then be added and filled with ballast. Two tiers of ballast cell units, one upon the other, will serve as a forty-eight inch high wall. The front of the cover sheet 23 is brought up over the filled ballast cell unit or units to form a strong two or four foot high barrier wall.

With the trusses in place, the versicle rise of the wall is eight feet. This can hold back a 7.5 foot rise of water. The Hydro Wall system uses the least amount of ballast of any known barrier wall of the same height and strength. This system also has the largest base, about twelve feet deep and ten feet wide per unit. The base is almost twice as deep as the height of the wall of water being held back. The catenary shape of the face of the wall utilizes the full weight of the oncoming water by translating the oncoming forces downward thus reducing the forward stresses against the wall and reinforcing the seal against the ground.

In another embodiment of the instant invention the cover sheet can be made longer by extending the back end 50 which can be brought up and fastened at a point about half-way up the rearward struts to which fastening means would be provided. This would form an additional catch-basin to hold back any water overflowing the barrier.

The truss units are made of a strong and lightweight material such as graphite reinforced fiberglass or other composite. Structural aluminum may also be used, or other materials known in the art.

The cover sheets and ballast cell units are made of laminated rubberized ripstop nylon or other such materials known in the art. The foam seals can be any closed cell firm foam which is non-absorbent to water. With the design and materials used, once cut or punctured, an opening in the cover sheet will not expand or otherwise enlarge. Prior art inflated barriers do not consider any protection against puncture due to sharp objects forced against such barriers, nor do the materials of which they are constructed prevent a puncture from enlarging.

The Hydro Wall can be easily assembled without tools and does not require exceptional strength since the individual components are not heavy. The ttydro Wall is composed of as many modules as are needed to form the necessary protective barrier. Two people can erect one Hydro Wall module, a ten foot section, in 15 to 20 minutes. The time required to fill with ballast depends upon the ballast used and how it is to be delivered to the site.

The most common barrier currently in use is still the sand bag wall. Even when sand is readily available or delivered to the site in sufficient quantities, many man hours are needed to fill and position the sand bags. This work requires considerable physical strength and stamina. Several thousand sand bags are needed to create a barrier equal to one Hydro Wall module.

With sufficient advance warning, a good defensive plan could result in miles of this type of protective wall in place before the advancing waters become a threat. To create the same barrier using sand bags would take months. When there is little advance warning, it is not difficult to see that much less time need be spent erecting the Hydro Wall which, in turn, will provide far more extensive and superior protection. When sand or other such ballast material is not available or cannot be brought to the site in time, the Hydro Wall can utilize the very flood waters it is geared to protect against.

To erect the hydro wall 20, the ground is cleared of rocks and debris along the periphery of the area to be protected. The back portion 50 of the cover sheet 23 is unfolded and placed on the ground with the front 51 folded portion facing the direction of the oncoming waters. The foam seals 24 permanently affixed to the obverse surface 45 of the cover sheet 23 lie directly on the ground. When more than one module is utilized, the cover sheets are placed side by side and the adjacent edges of the unfolded portions overlapped and joined together. The ballast cell units 22 are unrolled and placed on the cover sheets directly over the forward foam seal. The ballast cell units 22 are joined together end to end. Next, the truss units 21 are placed in the ballast cells. The support pads 36 of each unit are unfolded in turn to receive the next truss unit. The connecting rods 26 are put in place, guy wires 41 are fastened (if they are to be used) and the cells are filled with ballast 39. The front portions of the cover sheets are brought up, the adjoining edges sealed, the front ends 51 fastened to the tops of the truss units 21, and the armor plate units 25 are put in place.

After use, the Hydro Wall can be disassembled. The only difficulty is the removal of ballast when water is not used. The ballast may have to be removed by shoveling it out of the cells. When water is the ballast, the walls of the ballast cell units are pushed inward and the water allowed to run out.

While one embodiment of the invention has been illustrated and described in detail it is to be understood that this invention is not limited thereto and may be otherwise practiced within the scope of the following claims.

I claim:

1. A module for use in providing a barrier wall for containment of flood waters, said module comprising;

an elongated rectangular substantially flexible waterproof cover sheet, said cover sheet having a front end and a back end and containing means affixed to said cover sheet for sealing the module to the ground so as to prevent the flood waters from passing under said module; and at least one ballast cell unit in the form of a rectangular trough of substantially flexible waterproof material, containing a plurality of ballast cells, for placement on the back end of said cover sheet, the front end of said cover sheet being capable of covering said ballast cell unit on the side facing said flood waters to enhance the water impervious character of the barrier wall.

2. A module as in claim 1 wherein the ballast used to fill the ballast cells is selected from the group consisting of water, sand, earth and gravel.

3. A module for use in providing a barrier wall for containment of flood waters, said module comprising;

an elongated rectangular substantially flexible waterproof cover sheet, said cover sheet having a front end and a back end and containing means affixed to said cover sheet for sealing the module to the ground so as to prevent the flood waters from passing under said module;

a ballast cell unit, in the form of a rectangular trough of substantially flexible waterproof material, containing a plurality of ballast cells, for placement on the back end of said cover sheet;

a plurality of substantially triangular foldable support members, each for placement in a ballast cell, said support members being taller than the ballast cell and capable of receiving and supporting the front end of the cover sheet on the side facing the flood waters to provide a water impervious barrier wall of a height greater than that of the ballast cell unit.

4. A module as in claim 3 further comprising a plurality of lightweight rigid foldable armor plate sections, capable of being demountably fastened to the support members, for use over the cover sheet, so as to protect the cover sheet from damage by floating debris.

5. A module as in claim 3 wherein the ballast used to fill the ballast cells is selected from the group consisting of water, sand, earth and gravel.

6. A module for use in providing a barrier wall for containment of flood waters, said module comprising:

(a) an elongated rectangular substantially flexible waterproof coversheet, said cover sheet having a front end, a back end, an obverse surface, a reverse surface and two opposing longitudinal edges, the front end of which having a portion folded under with a multiplicity of reinforced openings symmetrically spaced along said folded portion, and with coupling means located along one longitudinal edge on the obverse surface and along the opposing longitudinal edge on the reverse surface;

(b) sealing means for sealing said module to the ground so as to prevent the flood waters from passing under said module, said sealing means being permanently affixed near the back end of the cover sheet on its obverse surface;

(c) a ballast cell unit in the form of a rectangular trough of substantially flexible waterproof material and containing a plurality of ballast cells, for placement atop the back end of said cover sheet over the sealing means, said ballast cell unit having two ends with coupling means on each end;

(d) a plurality of substantially triangular foldable support members, each for placement in a ballast cell, said support members being taller than the ballast cell and capable of receiving and supporting the front end of the cover sheet, and containing fastening means to coact with the openings in the cover sheet and to hold said cover sheet securely so as to provide a water impervious barrier wall facing the flood waters;

(e) connecting means to connect each support member to the adjoining support members so as to add stability to the module; and (f) a plurality of lightweight rigid foldable armor plate sections, capable of being demountably attached to the fastening means on said support members, for placement over the cover sheet, to protect the cover sheet from damage by floating debris.

7. A module as in claim 6 wherein the ballast used to fill the ballast cells is selected from the group consisting of water, sand, earth and gravel.

8. A module as in claim 6 wherein the sealing means comprises two transverse bands of compressible polymeric foam material.

9. A module as in claim 6 wherein the foldable support members are trusses, each of said trusses comprising three struts: a forward outer strut, a forward inner strut, and a rearward strut, and each of said struts having a top and a base, said struts being pivotally joined at their tops.

10. A module as in claim 9 wherein the two forward struts have a forward edge and a rear edge and are longer than the rearward strut, and said forward edge being curved as a catenary, said curve defining the shape of the module as it faces the flood waters.

11. A module as in claim 9 wherein the inner forward strut and the rearward strut have foldable support pads hingedly attached near their bases, said support pads having receiving channels to receive the bases of the adjoining struts.

12. A module as in claim 9 wherein there is an adjustable strap means affixed to a forward strut and the rearward strut to restrict their separation and assist in their positioning on uneven terrain.

13. A module as in claim 9 wherein guy wires are affixed to the rearward struts for added stability.

14. A method for erecting a barrier wall for containment of flood waters, said method comprising:

(a) clearing the ground along the periphery of the area to be protected;

(b) placing folded cover sheets with sealing means side by side along the cleared ground;

(c) unfolding the back ends of the cover sheets with the sealing means resting on the ground;

(d) coupling the unfolded portions of each cover sheet to the adjoining cover sheets;

(e) placing ballast cell units transversely atop the cover sheets directly over the sealing means;

(f) coupling the ends of each ballast cell unit to adjoining ballast cell units;

(g) filling the ballast cells with ballast;

(h) unfolding the front ends of the cover sheets, bringing the front ends back over the filled ballast cells so as to cover the ballast cells on the sides facing the flood waters; and (i) coupling the remainder of the cover sheets to the adjoining cover sheets.

15. A method for erecting a barrier wall for containment of flood waters, said method comprising:

(a) clearing the ground along the periphery of the area to be protected;

(b) placing folded cover sheets with sealing means side by side along the cleared ground;

(c) unfolding the back ends of the cover sheets with the sealing means resting on the ground;

(d) coupling the unfolded portions of each cover sheet to the adjoining cover sheets;

(e) placing ballast cell units transversely atop the cover sheets directly over the sealing means;

(f) coupling the ends of each ballast cell unit to adjoining ballast cell units;

(g) setting foldable support members into each ballast cell;

(h) connecting each support member to the adjoining support members with connecting means;

(i) filling the ballast cells with ballast;

(j) unfolding the front ends of the cover sheets, bringing the front ends to the tops of the support members, and fastening the cover sheets to the tops of the support members;

(k) coupling the remainder of the cover sheets to the adjoining cover sheets; and (l) attaching armor plate sections to tops of the support members over the cover sheets.

16. A method for erecting a barrier wall for containment of flood waters as in claim 15 further comprising the step of affixing guy wires to the support members.

* * * * *